US006565033B1

(12) United States Patent
Biagiotti

(10) Patent No.: US 6,565,033 B1
(45) Date of Patent: May 20, 2003

(54) PERIPHERAL REWINDING MACHINE FOR PRODUCING ROLLS OF WOUND WEB MATERIAL AND CORRESPONDING METHOD OF WINDING

(75) Inventor: Guglielmo Biagiotti, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 0 days.

(21) Appl. No.: 09/601,841

(22) PCT Filed: Feb. 8, 1999

(86) PCT No.: PCT/IT99/00028

§ 371 (c)(1),
(2), (4) Date: Aug. 9, 2000

(87) PCT Pub. No.: WO99/42393

PCT Pub. Date: Aug. 26, 1999

(30) Foreign Application Priority Data

Feb. 18, 1998 (IT) ..... FI98A0034

(51) Int. Cl.[7] ..... B65H 19/22

(52) U.S. Cl. ..... 242/533.7; 242/533.3; 242/609

(58) Field of Search ..... 242/533.2, 533.3, 242/533.7, 609

(56) References Cited

U.S. PATENT DOCUMENTS

| | | | |
|---|---|---|---|
| 2,968,448 | A | 1/1961 | Drum |
| 4,384,687 | A | 5/1983 | Lamoureux |
| 4,487,377 | A | 12/1984 | Perini |
| 5,137,225 | A | 8/1992 | Biagiotti |
| 5,248,106 | A | 9/1993 | Biagiotti |
| 5,249,756 | A | 10/1993 | Biagiotti |
| 5,368,252 | A | 11/1994 | Biagiotti |
| 5,538,199 | A | 7/1996 | Biagiotti |
| 5,639,046 | A | 6/1997 | Biagiotti |

FOREIGN PATENT DOCUMENTS

| | | |
|---|---|---|
| DE | 3510769 A1 | 10/1986 |
| GB | 2 105 688 A | 3/1983 |
| GB | 2 105 688 B | 3/1986 |
| GB | 2 268 477 | 1/1994 |
| IT | 1201390 | 1/1989 |
| WO | WO 94/21545 | 9/1994 |
| WO | WO 96/32350 | 10/1996 |

*Primary Examiner*—John Q. Nguyen
(74) *Attorney, Agent, or Firm*—Breiner & Breiner, L.L.C.

(57) ABSTRACT

The rewinding machine comprises: an insertion device (11) for sequentially inserting winding spindles (M) into a winding area; winding means (1, 3, 5) in said winding area, which wind predetermined quantities of web material onto said spindles; an extractor (25) for extracting said spindles from the rolls of web material formed on them; and a recirculation path (71) for returning the spindles extra from said rolls toward said insertion device. The spindles are made in two portions which can be connected and disconnected; the extractor extracts each of said two portions from a corresponding end of the corresponding wound roll. Means are also provided for reconnecting said two portions to each other so that said spindles can be reinserted into said winding area.

13 Claims, 4 Drawing Sheets

PERIPHERAL REWINDING MACHINE FOR PRODUCING ROLLS OF WOUND WEB MATERIAL AND CORRESPONDING METHOD OF WINDING

DESCRIPTION

1. Technical Field

The present invention relates to a peripheral rewinding machine for producing rolls of wound web material, comprising: insertion means for sequentially inserting winding spindles into a winding area; winding means, in said winding area, which wind predetermined quantities of web material onto the spindles; extraction means for extracting said spindles from the rolls of web material formed on them; and recirculation means for returning the spindles extracted from said rolls toward said insertion means.

The spindles may be caused to rotate by the winding means, or may be initially made to rotate by suitable members acting on them independently of the winding means.

The present invention also relates to a method for producing rolls of web material, comprising the stages of inserting a winding spindle into a winding area; winding a predeterminable quantity of web material on said winding spindle to form a roll around said winding spindle; and extracting said winding spindle from the roll.

2. Background Art

At the present time, the winding of web material for producing rolls is preferably carried out by means of rewinding machines of the peripheral type, in other words those in which the rotary motion for the winding is provided by members which act peripherally on the roll being formed. Examples of rewinders of this type are described, for example, in GB-A-2105688, U.S. Pat. Nos. 4,487,377, 5,249,756, 5,248,106, 5,137,225, 5,368,252, 5,639,046, 5,538,199, WO-A-9421545. These peripheral rewinders are of the continuous and automatic type, in the sense that they produce finished rolls in an automatic sequence, causing the interruption of the web material at the end of each winding operation and thus the formation of a tail edge of the finished roll and a leading edge of the following roll.

In some rewinding machines of known type, the winding is done on tubular winding cores or spindles, made from cardboard or similar, which remain inside the roll. In other machines of more recent design, the winding is done without a tubular winding core, as described for example in U.S. Pat. No. 5,639,046 or in U.S. Pat. No. 5,538,199. With these machines a compact roll without a central hole is produced. This makes it necessary to use special feeders for the use of the material.

IT-B-1201390 describes a peripheral rewinder in which the rolls are produced by winding on tubular spindles which are subsequently extracted from the formed roll. In this way, each roll has no central tubular core but has a hole for the insertion of a support typically used in feeders of material in roll form, for example feeders of kitchen paper, toilet paper or similar. This machine has the disadvantage that the extraction of a relatively long spindle from the roll requires a considerable tractive force to overcome the friction. Furthermore, the sliding of the whole length of the spindle inside the roll causes deformations of the inner turns of the wound web material.

SUMMARY OF THE INVENTION

The present invention relates to an improvement to peripheral rewinding machines with extractable winding spindles, of the type described, for example, in IT-B-1201390.

Essentially, the rewinding machine according to the invention is characterized in that the winding spindles are made in two portions which can be connected and disconnected; in that the extraction means extract each of said two portions from a corresponding end of the corresponding wound roll; and in that means are provided for reconnecting said two portions to each other so that said spindles can be reinserted into said winding area.

In this way, each portion of spindle has to travel for a shorter distance inside the roll to be extracted from it. The extraction means also have to travel for a shorter distance, and this enables the lateral dimensions to be limited, resulting in a greater ease of laying out the converting line.

This is particularly important because the present tendency in the field of the paper converting industry is to produce parent rolls of increasing length, with a consequent increase in the width of the rewinding lines. Furthermore, if two portions of spindle, each having a length approximately equal to half the length of the spindle, have to be extracted, this will yield a balancing and a reduction of the stress and a reduction of the deformation of the inner turns of the wound material.

In a possible embodiment of the invention, the extraction means used to extract the winding spindle are associated with two conveyers which extend laterally with respect to the winding area on both sides, to return the two portions of each spindle separately toward said insertion means, said means for reconnecting the two portions of said spindles to each other being located before the winding area. There is no reason why the two portions of spindle should not be connected before they are returned toward the insertion area, for example under the extraction area. In this case, it is possible to provide a single conveyer under the area of extraction of the two portions of spindle.

In a particularly advantageous embodiment, the conveyers comprise recirculation runways for returning the portions of said spindles, along which the portions of spindle roll by gravity.

The two portions of each spindle can be connected to each other by snap-fitting or other means. However, in a preferred embodiment, they have, at the ends to be connected, complementary conical surfaces which are used for the axial alignment of the two portions. Their detachment from each other can easily be prevented by positioning lateral containing walls along the spindle insertion path. When the winding has started, the two portions of spindle are held together by the turns being wound and by the contact with the winding members.

The method for producing rolls of web material according to the invention comprises the stages of inserting a winding spindle into a winding area; winding a predeterminable quantity of web material on said winding spindle to form a roll around said winding spindle; and extracting said winding spindle from the roll. Characteristically, according to the invention it is provided that said spindle is divided into two portions; said two portions are connected before the start of the winding of said web material on them; and the two portions of spindle are extracted separately from the two opposite ends of the roll wound on them.

Further advantageous embodiments of the invention are indicated in the attached claims.

BRIEF DESCRIPTION OF THE DRAWINGS

The invention will be more clearly understood from the description and the attached drawing, which shows a practical and non-restrictive example of the invention. The drawing shows.

DETAILED DESCRIPTION OF THE PREFERRED EMBODIMENT

In the following description, the invention is illustrated in its application to an automatic peripheral rewinder of the type described in WO-A-9421545, but it is to be understood that the same inventive concept may also be applied to automatic peripheral rewinders having other configurations.

Figure 1:
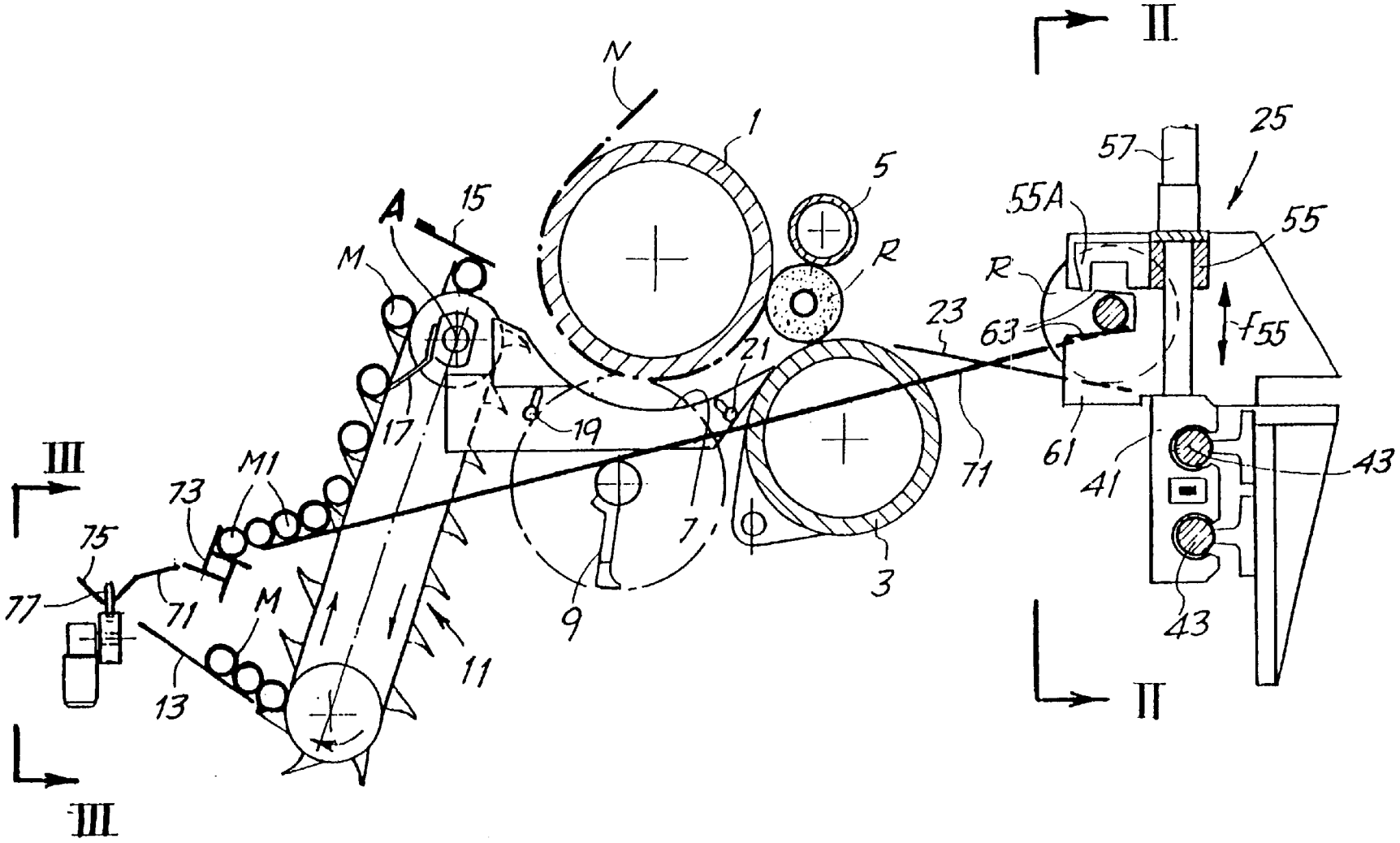
in FIG. 1, a schematic side view of a rewinding machine according to the invention.

FIG. 1 shows schematically the winding area of the peripheral rewinder. The letter N indicates a web material to be wound, for example a single or multiple web of paper, with transverse perforations if required, which is to be wound into rolls. The numbers 1, 3 and 5 indicate three winding rollers which delimit a winding area in which the rolls R are formed. The web material N is run around the upper winding roller 1 and the roll R is completed in the area formed among the rollers 1, 3 and 5 and in contact with these.

A curved surface 7 which forms an insertion channel for the winding spindles, indicated by M, is located under the winding roller 1. A rotating system 9 which interrupts the web material on completion of each individual roll R is located under the curved surface 7.

The winding spindles M are brought toward the insertion area, formed between the winding roller 1 and the curved surface 7, by means of a conveyer 11 which collects the individual spindles M from a runway 13. The spindles are brought to the upper area of the conveyer 11 by an intermittent motion and are retained there temporarily by a spring strip 15. The insertion into the curved channel formed by the winding roller 1 and the curved surface 7 is carried out by means of an insertion device 17 rotating about the axis A of the upper terminal wheel of the conveyer 11.

The winding systems and the winding spindle insertion systems described up to this point are essentially identical to those described in greater detail in WO-A-9421545, to which reference should be made.

In the initial winding area between the winding roller 1 and the curved surface 7 there are located sets of nozzles 19, 21, which, by means of air jets, start the winding of the free edge of web material generated by the cutting system 9 around a new winding spindle M inserted into the channel between the curved surface 7 and the winding roller 1. Alternatively, the winding may be started by wetting the winding spindle with water or other suitable liquid by one of the known systems, in such a way as to cause the temporary adhesion of the free edge. There is no reason why use should not be made of other systems for starting the winding of the free edge of the web material, such as electrostatic charges, suction spindles, or other equivalent systems.

Figure 4:
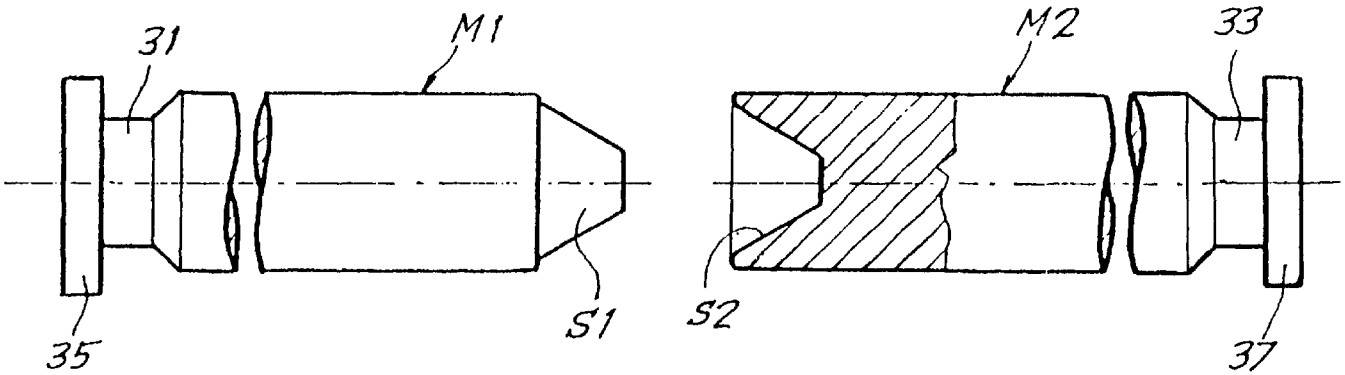
in FIG. 4, a detail of the surfaces for connecting together the two spindle portions, in a possible embodiment; and in FIG. 5, a layout of the machine.

On completion of the winding, the roll of web material R is discharged onto a discharge surface 23 and sent toward means indicated in a general way by 25, which extract the winding spindle from the roll. The winding spindle M is made in two portions, indicated by M1 and M2 in FIG. 4. The two portions are connected together by means of truncated conical connecting surfaces indicated by S1 for the portion M1 and by S2 for the portion M2. The surfaces S1 and S2 act only to bring the portions M1 and M2 into a coaxial configuration, a system of locking them together not being necessary. It is also possible to provide profiles with frontal engagement which prevent the rotation of the two portions with respect to each other if the first contact with the web material is not simultaneous and/or uniform in the two portions. For example, it is possible to provide frontal teeth, shaped in such a way as to cause the two portions to be made to rotate simultaneously. The opposite ends of the portions M1 and M2 of the winding spindle from the surfaces S1 and S2 have two collars 31, 33 and two heads 35, 37 which enable the two portions of spindle M1 and M2 to be gripped and extracted, in the way described below, from the formed roll.

Figure 2:
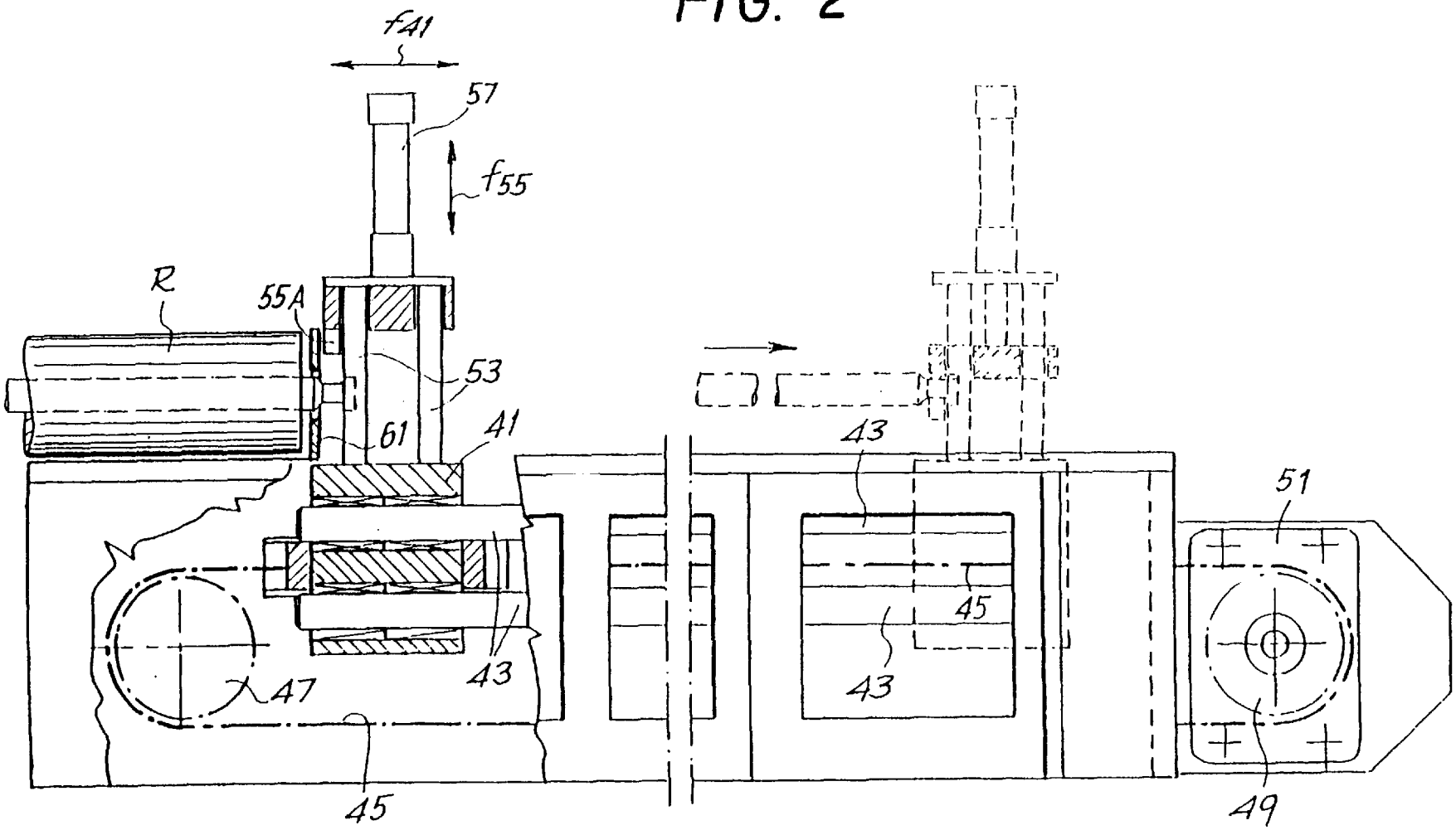
in FIG. 2, a view in the direction II—II in FIG. 1 of a part of the means of extracting the spindle portions from the finished roll.

The extraction means 25 are double, for the extraction of each portion M1, M2 of the winding spindle M. FIG. 2 shows one of the two means of extracting one of the two portions M1, M2 of the winding spindle, the other extraction means being symmetrical and being located on the opposite side of the rewinder. For each portion M1, M2 of spindle, the extraction means have a sliding block 41 slidable on guide bars 43 and fixed to a chain or other equivalent endless flexible member indicated by 45, running around two pulleys 47, 49. Other equivalent mechanisms may be used for the extraction, for example pneumatic or hydraulic actuators with or without rods. In general, use may be made of any system suitable for gripping the projecting end of each portion of spindle and of extracting it from the roll which has been wound on it.

The number 51 indicates the drive to the endless flexible member 45, which causes an alternating movement of the sliding block 41 as shown by the double arrow f41. The sliding block carries two guide columns 53 for an extraction member 55 which is movable vertically as shown by the double arrow f55 by means of a cylinder and piston actuator 57 carried by the sliding block 41. The extraction member 55 has a jaw 55A which is used to grip the end of the corresponding portion M1 or M2 of the winding spindle M at the collar 31 or 33, between the body of the portion of spindle and the head 35 or 37.

In a possible alternative embodiment, a single endless flexible member of the chain or similar type can act on two sliding blocks 41 located on the two sides of the machine. In this case, each sliding block is fixed to one of the two parallel sides of the flexible member. The movement of the flexible member causes the simultaneous movement in opposite directions of the two sliding blocks, with consequent simultaneous extraction of the two portions of spindle from the roll, which is not subjected to stresses which would cause it to make an undesired transverse movement.

To carry out the extraction of the two portions M1, M2 of the winding spindle from the formed roll R, the roll is made to roll along the discharge surface 23 until it is stopped between two side pieces 61, only one of which is visible in FIGS. 1 and 2. The side pieces 61 have seats 63, open toward the winding area, into which the ends of the portions M1, M2 of the winding spindle M projecting from the roll R are inserted when the roll R is discharged onto the discharge surface 23. In this way the roll R is held in a defined position (see FIG. 1 in particular) by the retaining of the projecting ends of the portions M1, M2 of the winding spindle M.

The side pieces 61 may be adjustable so that they can be matched to the axial dimension of the rolls R. When the roll R has reached the position between the side pieces 61, the sliding blocks 41 of each of the two extraction means 25 on the two sides of the rewinder may be positioned adjacent to the side pieces 61 to bring, by a downward movement in the direction of the arrow f55, the corresponding jaw 55 into engagement with the corresponding projecting end of the portion M1 or M2 of the spindle. At this point, the sliding block,41 is made to slide along the guides 43 to extract the corresponding portion M1, M2 of spindle until it is brought into the position indicated in broken lines in FIG. 2. The roll R is prevented from following the axial extraction movement by the presence of the side pieces 61.

When the extraction of the two portions M1, M2 of spindle is complete, the roll is no longer held between the two side pieces 61 and can continue the movement of discharge under the force of gravity alone or by other auxiliary means, such as a system of drive belts, toward conveyer members which are not shown and which are of a known type.

Figure 3:
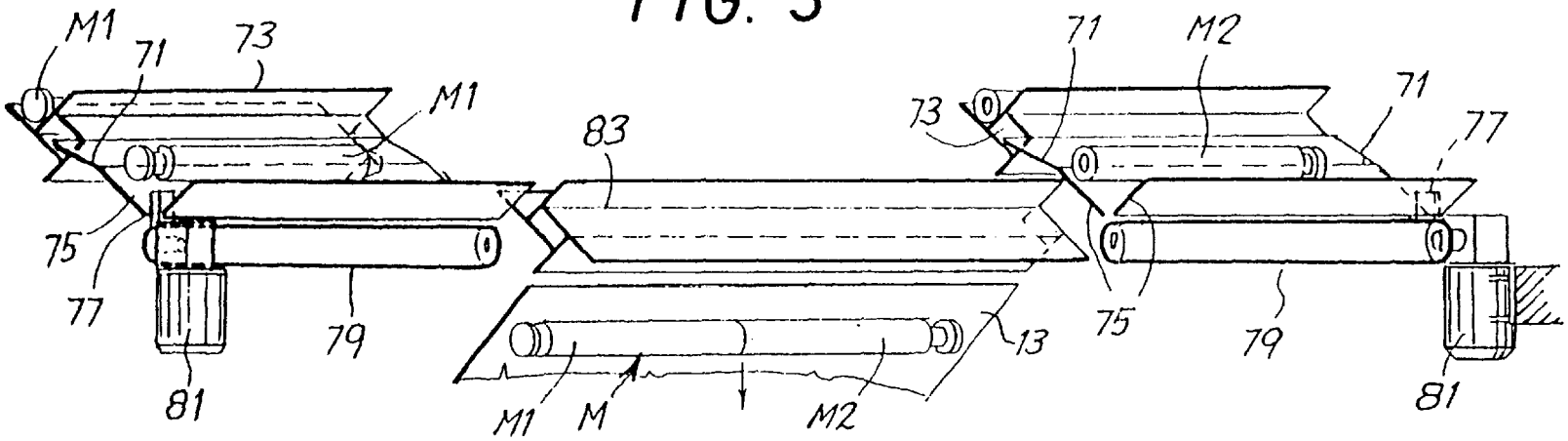
in FIG. 3, a local view in the direction III—III in FIG. 1, showing the means for reconnecting the spindle portions.

The two portions M1, M2 of spindle extracted from the roll R are made to return toward the entry area of the rewinder by two lateral conveyers which, in the illustrated example, consist of simple inclined guide surfaces 71, along which the portions M1 and M2 of spindle roll by gravity until they reach corresponding rotating distributors 73 located in the terminal areas of the guide surfaces 71. The portions M1, M2 of the winding spindles accumulate behind the rotating distributor 73 which, for each of the guide surfaces 71, discharge the portions M1 or M2 of spindle individually toward a corresponding cradle 75 having a V-shaped cross section (see FIG. 3 in particular).

Each of the two cradles 75 is associated with a corresponding longitudinal pusher 77 fixed to an actuator which consists, in the illustrated example, of a flexible member 79 driven by a corresponding motor 81. When a corresponding portion M1 or M2 of spindle has been discharged into the corresponding cradle 75, the two pushers 77 are driven simultaneously to push the two portions M1 and M2 toward an intermediate cradle which constitutes the extension of the two cradles 75 and which is formed by a central rotating distributor 83. The simultaneous movement of the two pushers 77 toward the rotating distributor 83 not only causes the portions M1 and M2 of spindle to be discharged onto the cradle formed by the central rotating distributor 83, but also causes them to be connected axially at the surfaces S1 and S2, so that the complete winding spindle is reconstituted on the cradle formed by the rotating distributor 83. The rotation of the central distributor 83 then causes the discharge of the winding spindle M, reassembled in this way, on the central runway 13 toward the conveyer 11 which returns the spindle to the winding area.

To prevent the accidental disconnection of the portions M1 and M2 of spindle along the path from the central distributor 83 to the winding area delimited by the roll 1 and the curved surface 7, it is possible to have the spindle path delimited laterally by retaining side pieces which prevent axial movements of the portions M1 and M2.

The winding takes place preferably (as described above) directly onto the extractable spindle. However, there is no reason why a tubular core should not be threaded onto the two portions of the spindle which have been connected together, and the web material wound onto the tubular core which subsequently remains integral with the roll, while the spindle is extracted from the tubular core. In this case, the finished product will consist of turns of web material wound on a tubular core whose thickness and density may be less than those of the conventional tubular cores used for this purpose. However, the first possibility (with winding directly onto the spindle) is preferable, since it enables rolls with axial holes but without tubular cores to be produced.

Figure 5:
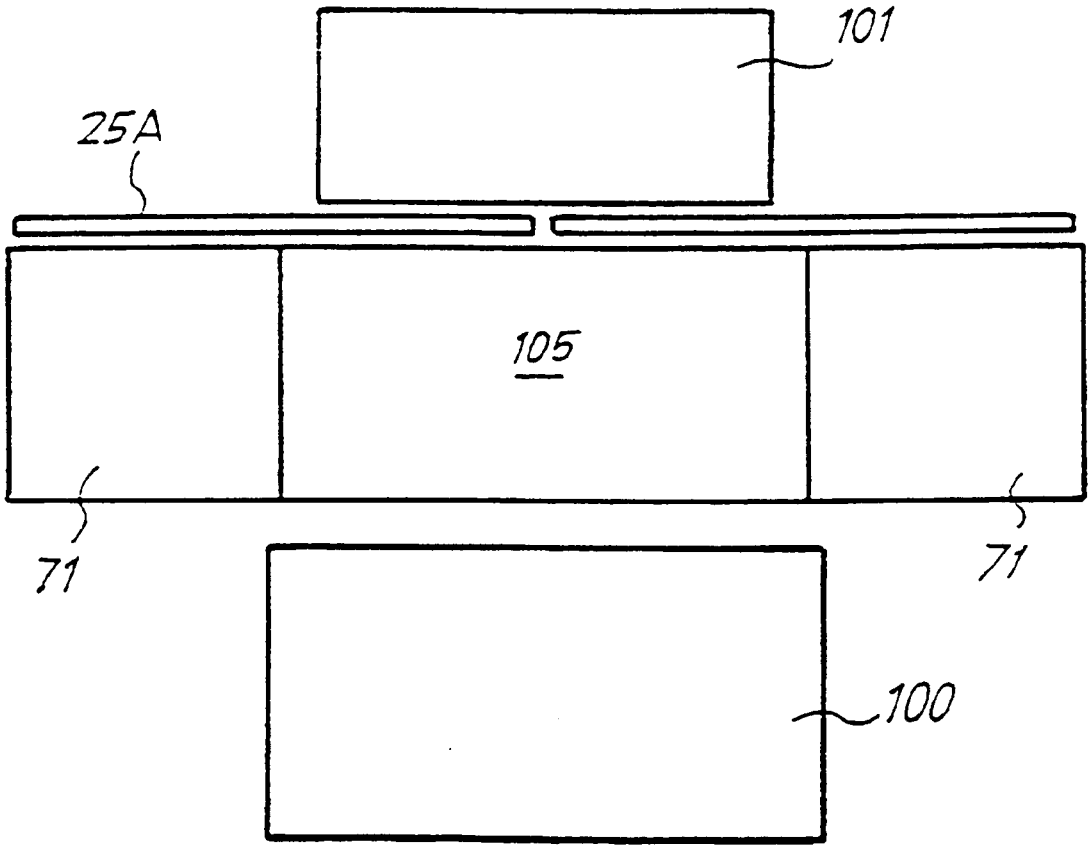

FIG. 5 shows a schematic plan view of the layout of the machine, in which the number 100 indicates an unwinder of parent rolls and 101 indicates a gluing machine for gluing the rolls supplied by the rewinder which is indicated in a general way by 105. The two extraction means are indicated by 25A and 25B.

It is to be understood that the drawing shows only an example provided solely as a practical demonstration of the invention, and that this invention may be varied in its forms and dispositions without departure from the guiding concept of the invention. Any reference numbers present in the attached claims have the purpose of facilitating the reading of the claims with reference to the description and to the drawing, and do not limit the scope of protection represented by the claims.

What is claimed is:

1. A peripheral rewinding machine for producing rolls of wound web material, comprising an insertion device for sequentially inserting winding spindles into a winding area; winding means in said winding area, which wind predetermined quantities of web material onto said spindles to form said rolls; downstream of said winding area, an extractor for extracting said spindles from the rolls of web material formed thereon; a recirculation path for returning the spindles extracted from said rolls toward said insertion device; wherein each of said spindles is present in two portions which can be connected and disconnected, said extractor extracts each of said two portions from a corresponding end of a corresponding wound roll, and means are provided for reconnecting said two portions to each other before said spindles are reinserted into said winding area, said means for reconnecting being arranged along said recirculation path.

2. The machine as claimed in claim 1, wherein said extractor is associated with two conveyers which extend laterally with respect to the winding area, to return the two portions of each spindle separately toward said insertion device, said means for reconnecting the two portions of said spindles to each other being located before the winding area.

3. The machine as claimed in claim 2, wherein said conveyers comprise runways for recirculating the two portions of said spindles.

4. The machine as claimed in claim 1, wherein said means for reconnecting the two portions of said spindles connect said two portions before the spindles are returned toward the insertion device.

5. The machine as claimed in claim 1, 2, 3 or 4, wherein said two portions of each spindle have, at the ends to be connected, complementary conical surfaces.

6. The machine as claimed in claim 1, 2, 3 or 4, wherein said means for reconnecting the two portions of each spindle to each other comprise longitudinal guide members for the two portions to be connected and axial pushing members which push said two portions toward each other.

7. A method for producing rolls of web material, comprising: inserting a winding spindle into a winding area; winding a predetermined quantity of web material on said winding spindle to form a roll around said winding spindle; discharging said roll from said winding area; and thereafter extracting said winding spindle from the roll; wherein said spindle is present in two portions, said two portions are connected before introducing said spindle into said winding area, and the two portions of a spindle are extracted separately from opposite ends of the roll after the roll has been discharged from the winding area.

8. The method as claimed in claim 7, wherein said two portions of said spindle are separately conveyed from an extractor which extracts said two portions from said roll toward an insertion device, and are connected to one another before said insertion device introduces said spindle into said winding area.

9. The method as claimed in claim 7, wherein said two portions of said spindle are reconnected to one another after having been extracted from said roll and the spindle formed by said two reconnected portions is returned toward an insertion device for insertion into said winding area.

10. A peripheral rewinding machine for producing rolls of wound web material, comprising an insertion device for sequentially inserting winding spindles into a winding area; winding means in said winding area, which wind predetermined quantities of web material onto said spindles to form said rolls; downstream of said winding area, an extractor for extracting said spindles from the rolls of web material formed thereon; a recirculation path for returning the spindles extracted from said rolls toward said insertion device; wherein each of said spindles is present in two portions which can be connected and disconnected, said extractor extracts each of said two portions from a corresponding end of a corresponding wound roll, and means are provided for reconnecting said two portions to each other before said spindles are reinserted into said winding area, wherein said means for reconnecting the two portions of each spindle to each other comprise longitudinal guide members for the two portions to be connected and axial pushing members which push said two portions toward each other and wherein said axial pushing members comprise an intermediate rotating distributor on which said two portions are connected together, the distributor discharging the connected spindles toward the insertion device.

11. The machine as claimed in claim 10, wherein said extractor is associated with two conveyers which extend laterally with respect to the winding area, to return the two portions of each spindle separately toward said insertion device, said means for reconnecting the two portions of said spindles to each other being located before the winding area.

12. The machine as claimed in claim 11, wherein said conveyers comprise runways for recirculating the two portions of said spindles.

13. The machine as claimed in claim 10, wherein said means for reconnecting the two portions of said spindles connect said two portions before the spindles are returned toward the insertion device.

* * * * *

UNITED STATES PATENT AND TRADEMARK OFFICE

CERTIFICATE OF CORRECTION

PATENT NO. : 6,565,033 B1
DATED : May 20, 2003
INVENTOR(S) : Guglielmo Biagiotti It is certified that error appears in the above-identified patent and that said Letters Patent is hereby corrected as shown below:

Title page,
Item [57], ABSTRACT,
Line 7, “extra” should read -- extracted --.

Column 5,
Line 8, “block,41” should read -- block 41 --.

Signed and Sealed this

Eighth Day of July, 2003

JAMES E. ROGAN
*Director of the United States Patent and Trademark Office*